US008405479B1

(12) United States Patent
Cleveland

(10) Patent No.: US 8,405,479 B1
(45) Date of Patent: Mar. 26, 2013

(54) THREE-DIMENSIONAL MAGNET STRUCTURE AND ASSOCIATED METHOD

(75) Inventor: Mark Allen Cleveland, Westminster, CA (US)

(73) Assignee: The Boeing Company, Chicago, IL (US)

( * ) Notice: Subject to any disclaimer, the term of this patent is extended or adjusted under 35 U.S.C. 154(b) by 369 days.

(21) Appl. No.: 12/645,134

(22) Filed: Dec. 22, 2009

(51) Int. Cl.
*H01F 7/02* (2006.01)

(52) U.S. Cl. ..... 335/306; 335/302; 335/296

(58) Field of Classification Search ..... 335/302–306, 335/296
See application file for complete search history.

(56) References Cited

U.S. PATENT DOCUMENTS

| | | | | |
|---|---|---|---|---|
| 5,635,889 | A * | 6/1997 | Stelter | 335/306 |
| 6,084,498 | A * | 7/2000 | Stelter et al. | 335/306 |
| 6,680,663 | B1 | 1/2004 | Lee et al. | |
| 7,084,633 | B2 * | 8/2006 | Aoki et al. | 324/319 |
| 7,148,777 | B2 | 12/2006 | Chell et al. | |
| 7,199,689 | B1 | 4/2007 | Abele | |
| 2008/0224557 | A1 | 9/2008 | Cleveland | |

OTHER PUBLICATIONS

Jan Sandtner, Hannes Bleuler, Electrodynamic Passive Magnetic Bearing With Planar Halbach Arrays, *Ninth International Symposium on Magnetic Bearings*, Aug. 3-6, 2004, Lexington, Kentucky.

H. Bleuler, J. Sandtner, Y.-J. Regamey, F. Barrot, Passive Magnetic Bearings for Flywheels, *Ecole Polytechnique Federale de Lausanne, Laboratory of Robotic System* (*LSRO*) , 2005, CH-1015 Lausanne, Switzerland.

* cited by examiner

*Primary Examiner* — Bernard Rojas
(74) *Attorney, Agent, or Firm* — Alston & Bird LLP

(57) ABSTRACT

A magnet structure is provided that includes a first layer of magnets including a first pole magnet and a plurality of first magnets that are positioned about the first pole magnet. The plurality of first magnets are oriented to have respective magnetic fields directed inward relative to the first pole magnet. The magnet structure may also include a second layer of magnets including a second pole magnet and a plurality of second magnets positioned about the second pole magnet and oriented such that the plurality of second magnets have respective magnetic fields directed outward relative to the second pole magnet. The magnet structure may also include a planar magnet positioned between the first and second layers of magnets and oriented such that the planar magnet repels each of the first and second layers of magnets. A magnet assembly and an associated method are also provided.

18 Claims, 6 Drawing Sheets

THREE-DIMENSIONAL MAGNET STRUCTURE AND ASSOCIATED METHOD

TECHNOLOGICAL FIELD

Embodiments of the present invention relate generally to magnets and, more particularly, to three-dimensional magnet structures and associated methods.

BACKGROUND

A variety of magnets are utilized in an increasing number of applications including, for example, in the stator and rotor of electric motors and generators. In this regard, with the growing interest in electric vehicles and in renewable energy applications that utilize electric motors and generators, the demand for magnets is correspondingly growing.

The magnets utilized in the stator and rotor of electric motors and generators may include permanent magnets formed of various materials, such as rare earth neodymium iron boron in order to increase the flux density in the air gap. The magnets may also be arranged in a Halbach array, arranged to have a dual flux path, or configured to have an iron backing or a yoke so as to further increase the flux density in the air gap.

In many applications, however, magnets are desired to provide even further increased levels of flux density without increasing the size and weight, or perhaps while reducing the size and weight, of the resulting magnet structure. By increasing the flux density while maintaining or decreasing the size and weight of the magnet structure, the performance and efficiency of the magnet structure may be increased, thereby correspondingly improving the performance and efficiency of the electric motor or generator. In instances in which the magnet structure is utilized in a vehicular application, such as an electric vehicle or an airborne vehicle, the increased performance and efficiency may provide reduced fuel consumption and/or increased range and reliability. Similarly, in renewable energy applications that utilize electric motors or generators, a magnet structure offering improved performance and efficiency with no corresponding increase in weight may correspondingly improve the performance and potentially decrease the cost of the electric motors and generators utilized in the renewable energy applications.

Accordingly, it would be desirable to provide an improved magnet structure capable of providing increased flux density in the air gap of an electric motor, generator or the like without a corresponding increase in the size and weight of the magnet structure.

BRIEF SUMMARY

According to embodiments of the present invention, a magnet structure is provided that is comprised of a plurality of individual magnets arranged in a configuration that may provide increased levels of magnetic flux without necessarily a corresponding increase in the size and weight of the magnet. A corresponding method of utilizing a magnet structure is also provided according to one embodiment. By providing magnet structures that may provide improved efficiency with increased flux density without corresponding increases in the size and weight, improved electric motors and generators incorporating such magnet structures may be provided, thereby facilitating performance improvements in the applications in which such electric motors and generators are utilized, such as vehicular applications, renewable energy applications and the like.

In accordance with one embodiment, a magnet structure is provided that includes a first layer of magnets including a first pole magnet and a plurality of first magnets that are positioned about the first pole magnet. The plurality of first magnets are oriented such that the plurality of first magnets have respective magnetic fields directed inward relative to the first pole magnet. The magnet structure of this embodiment also includes a second layer of magnets including a second pole magnet and a plurality of second magnets positioned about the second pole magnet and oriented such that the plurality of second magnets have respective magnetic fields directed outward relative to the second pole magnet. The magnet structure of this embodiment also includes a planar magnet positioned between the first and second layers of magnets and oriented such that a south pole of the planar magnet is disposed in a facing relationship to a south pole of the first layer of magnets and such that a north pole of the planar magnet is disposed in a facing relationship to a north pole of the second layer of magnets. Additionally, the first pole magnet may have a north pole that faces away from the planar magnet and the second pole magnet may have a south pole that faces away from the planar magnet.

The first and second pole magnets may be formed of a material having greater permeability than the plurality of the first and second magnets, respectively. For example, the first and second pole magnets may be formed of high permeability materials, such as soft iron, ferrite or mu-metals. The planar magnet of one embodiment has a surface area that is at least as large as the surface area the first and second layers of magnets. In addition, the planar magnet of one embodiment has a thickness that is less than the thickness of the first and second layers of magnets.

In another embodiment, a magnet assembly is provided that includes at least one magnet structure with each magnet structure including first and second layers of magnets and a planar magnet positioned between the first and second layers of magnets and oriented such that the planar magnet repels each of the first and second layers of magnets. In this embodiment, each layer of magnets includes a pole magnet and a plurality of additional magnets positioned about the pole magnet. The plurality of additional magnets of a respective layer of magnets are oriented such that the plurality of additional magnets have respective magnetic fields directed in a common direction inward or outward relative to the pole magnet. In one embodiment of the magnet assembly in which each magnet structure has a predefined magnetic field, the plurality of magnet structures are positioned proximate one another with the predefined magnetic field of each magnet structure oriented in a common direction inward or outward.

The magnet structure of one embodiment includes a planar magnet positioned between the first and second layers of magnets and oriented such that a south pole of the planar magnet is disposed in a facing relationship to a south pole of the first layer of magnets and a north pole of the planar magnet is disposed in a facing relationship to a north pole of the second layer of magnets. Further, the pole magnet of the first layer of magnets may have a north pole that faces away from the planar magnet and the pole magnet of the second layer of magnets may have a south pole that faces away from the planar magnet.

The pole magnets of one embodiment may be formed of a material having greater permeability than the plurality of additional magnets. For example, the pole magnets may be formed of high permeability materials, such as soft iron, ferrite or mu-metals. The planar magnet of each magnet structure of one embodiment may have a surface area that is at least as large as the surface area of the respective layer of magnets.

The planar magnet of each magnet structure may also have a thickness that is less than the thickness of the respective layer of magnets.

In another embodiment, a method is provided that includes providing a magnet structure comprising first and second layers of magnets and a planar magnet positioned between the first and second layers of magnets and oriented such that the planar magnet repels each of the first and second layers of magnets. Each layer of magnets includes a pole magnet and a plurality of additional magnets positioned about the pole magnet with the plurality of additional magnets of a respective layer of magnets oriented such that the plurality of additional magnets have respective magnetic fields directed in a common direction inward or outward relative to the pole magnet. The method of this embodiment also includes generating magnet flux utilizing the magnet structure.

In one embodiment, the method may also include the provision of a magnet assembly that includes a plurality of magnet structures with each magnet structure having a predefined magnetic field. In this embodiment, the magnet assembly may include the plurality of magnet structures positioned proximate one another with the predefined magnetic field of each magnet structure oriented in a common direction inward or outward.

The method of one embodiment provides the first layer of magnets so as to have a first pole magnet with a north pole oriented to face away form the planar magnet and provides the second layer of magnets so as to have a second pole magnet with a south pole oriented to face away from the planar magnet. The pole magnets may be formed of a material having greater permeability than the plurality of additional magnets, such as a material selected from the group consisting of soft iron, ferrite and mu-metals. The planar magnet of one embodiment may have a surface area at least as large as a surface area of the respective first and second layers of magnets. Additionally or alternatively, the planar magnet may have a thickness that is less than a thickness of the respective first and second layers of magnets.

The features, functions, and advantages that have been discussed can be achieved independently and various embodiments of the present disclosure may be combined in yet other embodiments, further details of which can be seen with reference to the following description and drawings.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
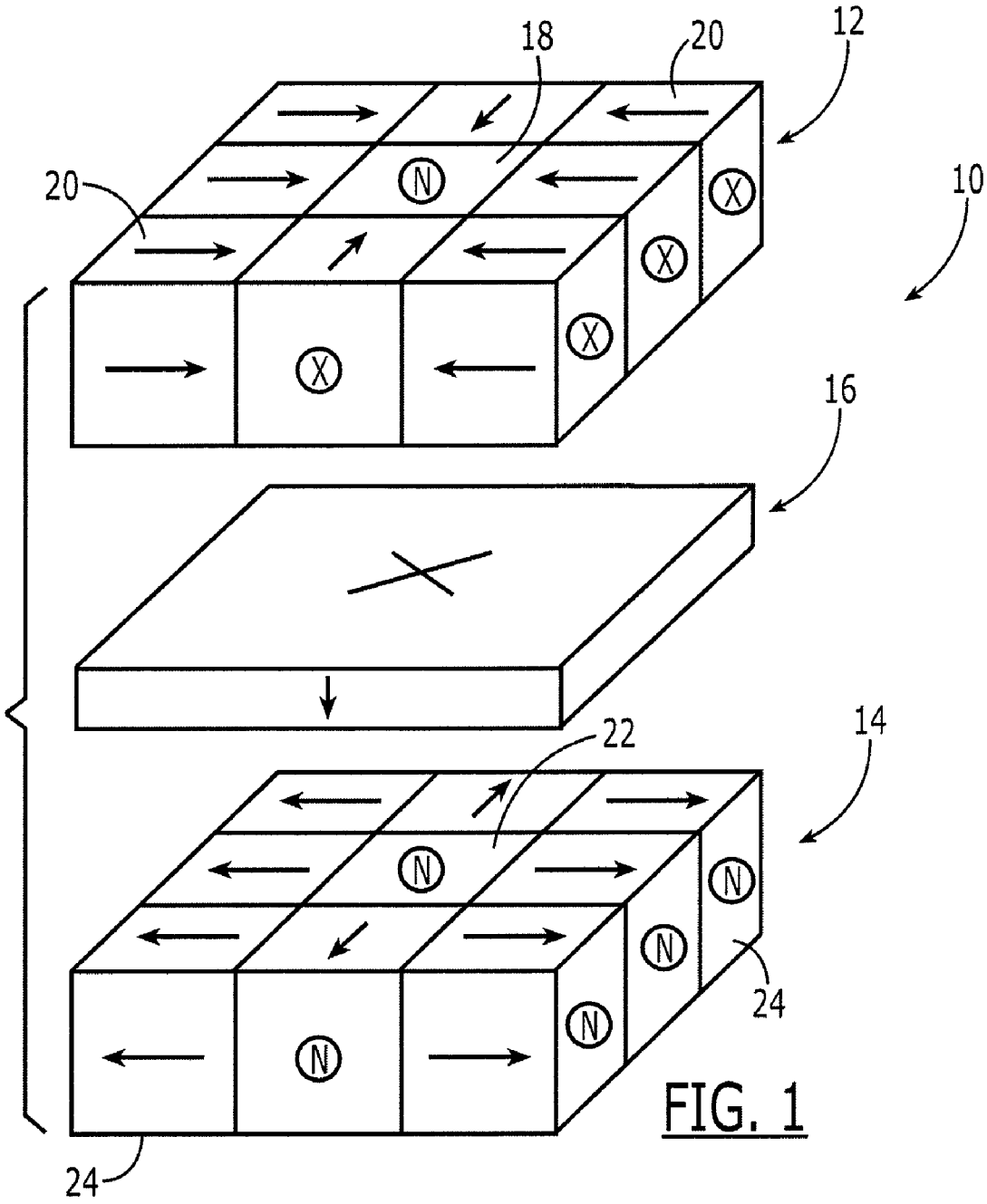
FIG. 1 is a perspective view of a magnet structure according to one embodiment of the present invention in which the first and second layers of magnets and the planar magnet are spaced apart from one another prior to assembly.
Figure 2:
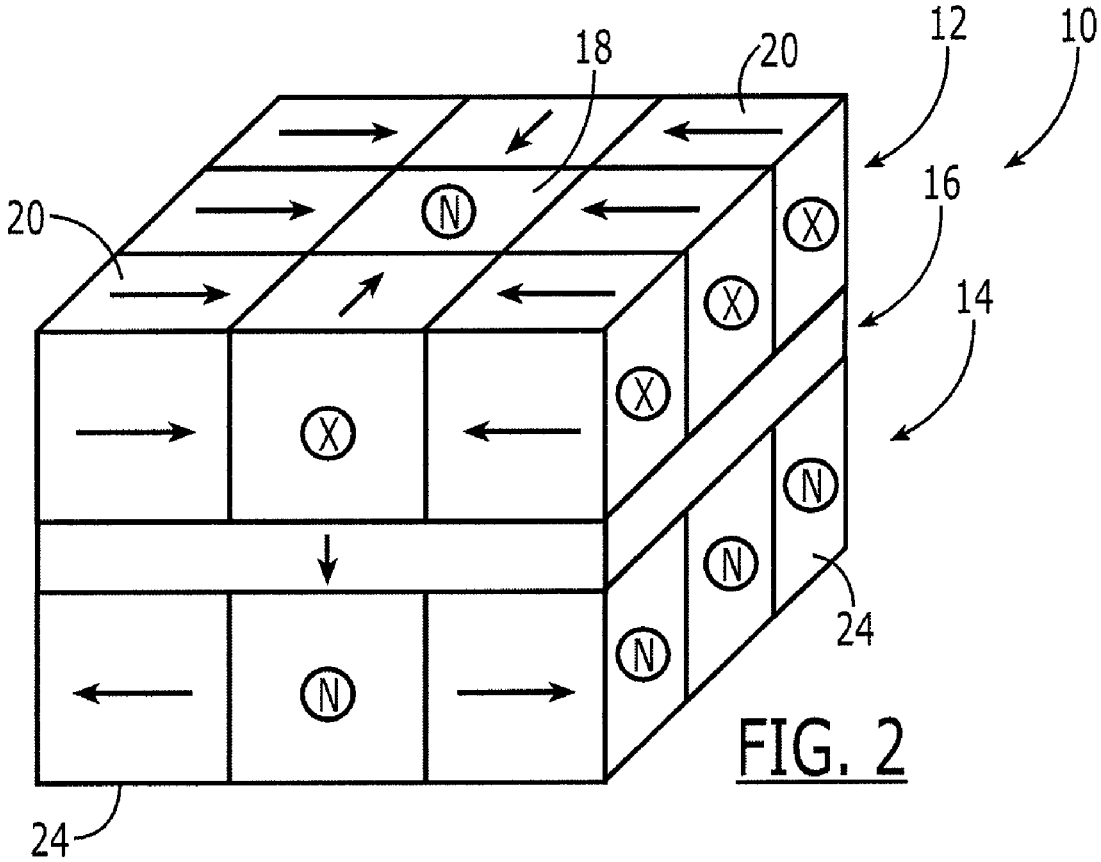
FIG. 2 is a perspective view of the magnet structure of FIG. 1 following assembly.

Referring now to FIGS. 1 and 2, a magnet structure 10 is depicted in accordance with one embodiment of the present invention. The magnet structure includes first and second layers 12, 14 of magnets positioned in planar arrays on opposite side of a planar magnet 16 and oriented in such a manner as to provide an improved or increased magnetic flux field. Each layer of magnets includes a pole magnet 18, 22 and a plurality of additional magnets 20, 24 positioned about the pole magnet. In the embodiment depicted in FIGS. 1 and 2, each of the pole magnet and the additional magnets is a permanent magnet having opposed north and south poles, as designated by the N and X designations, respectively, with a magnetic field directed from the south pole to the north pole as indicated by the arrows. The pole magnet and the additional magnets may each be in the shape of a cube and may each have the same size. While the magnets may have a variety of sizes, the pole magnet and additional magnets of one embodiment are in the shape of a cube measuring 1 mm on a side. Each of the additional magnets and, in the embodiment depicted in FIGS. 1 and 2, the pole magnets may be formed of the same permanent magnet material, such as neodymium or a combination of neodymium, iron and boron. However, the layers of magnets may be formed of pole magnets and additional magnets having different shapes, sizes, and formed of different materials in other embodiments.

In one embodiment, the first and second layers of magnets 12, 14 are formed of the same number of additional magnets 20, 24 that are positioned about the respective pole magnet 18, 22 with the pole magnet and additional magnets of the first layer of magnets being of the same size and shape and being formed of the same material as those of the second layer of magnets such as both the first and second layers of magnets have the same size and shape. However, the additional magnets of the first layer of magnets and the additional magnets of the second layer of magnets may be oriented differently relative to the respective pole magnet (as indicated by the oppositely directed magnetic fields) such that the first and second layers of magnets have the same or nearly the same flux field, but of opposite polarities.

In the embodiment depicted in FIGS. 1 and 2, the pole magnet 18 of the first layer of magnets 12 may be oriented such that the north pole faces upwards and the additional magnets 20 may be oriented such that the additional magnets have respective magnetic fields directed inward relative to the pole magnet. See, for example, the inwardly facing arrows of the additional magnets of the first layer of magnets. In order for the magnetic fields of the additional magnets to be directed inward relative to the respective pole magnet, the north poles of the additional magnets face inward toward from the respective pole magnet and the south poles of the additional magnets face outward away from the respective pole magnet. Conversely, the additional magnets 24 of the second layer of magnets 14 are positioned about the respective pole magnet 22 and oriented oppositely such that the magnetic fields of the additional magnets are directed outward relative to the respective pole magnet. In this regard, the additional magnets may be positioned relative to the respective pole magnet of the second layer of magnets such that the north poles of the additional magnets are oriented outward away from the respective pole magnet and the south poles of the additional magnets are oriented inward toward the respective pole magnet. By positioning the additional magnets of the first and second layers of magnets such that the respective magnetic fields of the additional magnets are differently oriented, the first layer of magnets produces the highest peak north facing flux density, while the second layer of magnets produces the highest peak south facing flux density.

As shown in FIGS. 1 and 2, a planar magnet 16 may then be disposed between the first and second layers of magnets 12, 14. In one embodiment, the planar magnet is sized to have a surface area that at least equals the surface area of the first and second layers of magnets. The planar magnet may have the same thickness as the first and second layers of magnets, may be thinner than the first and second layers of magnets as shown in FIGS. 1 and 2 or be thicker than the first and second layers of magnets in other embodiments. Although not necessary, the planar magnet may be formed of the same permanent magnet material, such as a neodymium iron boron material, as the magnets of the first and second layers of magnets. Regardless of the material, the planar magnet is positioned such that the opposed north and south poles of the planar magnet repel each of the first and second layers of magnets. In the embodiment of FIGS. 1 and 2 in which the first layer of magnets has the highest peak north facing flux density and the second layer of magnets has the highest peak south facing flux density, the planar magnet may be positioned between the first and second layers of magnets such that the south pole of the planar magnet faces the first layer of magnets and the north pole of the planar magnet faces the second layer of magnets. Once the magnet structure 10 is assembled as shown in FIG. 2, the resulting magnet structure produces a substantial flux field while being relatively light and compact. As a point of comparison, a magnet structure of the embodiment of FIG. 2 may generate a flux field of 0.822 Tesla as compared to the 0.577 Tesla produced by a reference model of the same construction but with all of the magnets having a magnetic field pointing upwards in the orientation of FIG. 2.

Figure 3:
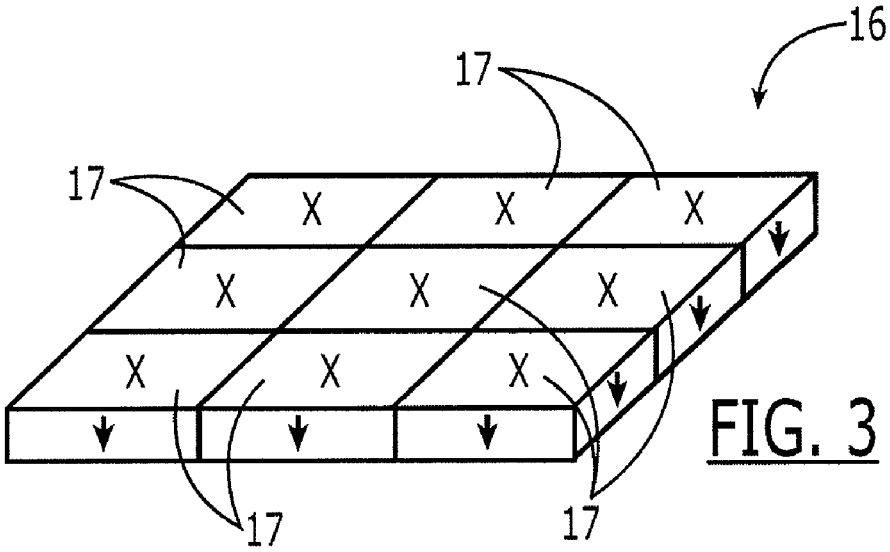
FIG. 3 is a perspective view of a planar magnet of an alternative embodiment of the present invention.

As described above, the planar magnet 16 was formed of a single magnet. However, the planar magnet may, instead, be formed of an array or layer of magnets as shown, for example, in FIG. 3. In this embodiment, the planar magnet comprises a plurality of magnets 17. Each of the magnets is oriented in the same direction. In the illustrated embodiment, for example, each individual magnet is oriented such that its south pole faces upward, so as to face the first layer 12 of magnets in the embodiment of FIGS. 1 and 2, and its north pole faces downward, so as to face the second layer 14 of magnets in the embodiment of FIGS. 1 and 2. In other words, the planar magnet is oriented in an opposite manner to the pole magnets 18, 22 of the first and second layers of magnets. With respect to the embodiments of FIGS. 1-3, for example, the north poles of the pole magnets of the first and second layers of magnets face upwardly, while the north pole(s) of the planar magnet faces downwardly. As such, regardless of whether the planar magnet is a single magnet as in FIGS. 1 and 2 or an array or layer of magnets as in FIG. 3, the south pole of the planar magnet may be disposed in a facing relationship to a south pole of the first layer of magnets and the north pole of the planar magnet may be disposed in a facing relationship to a north pole of the second layer of magnets. Further, the pole magnet of the first layer of magnets may have a north pole that faces away from the planar magnet and the pole magnet of the second layer of magnets may have a south pole that faces away from the planar magnet.

Figure 4:
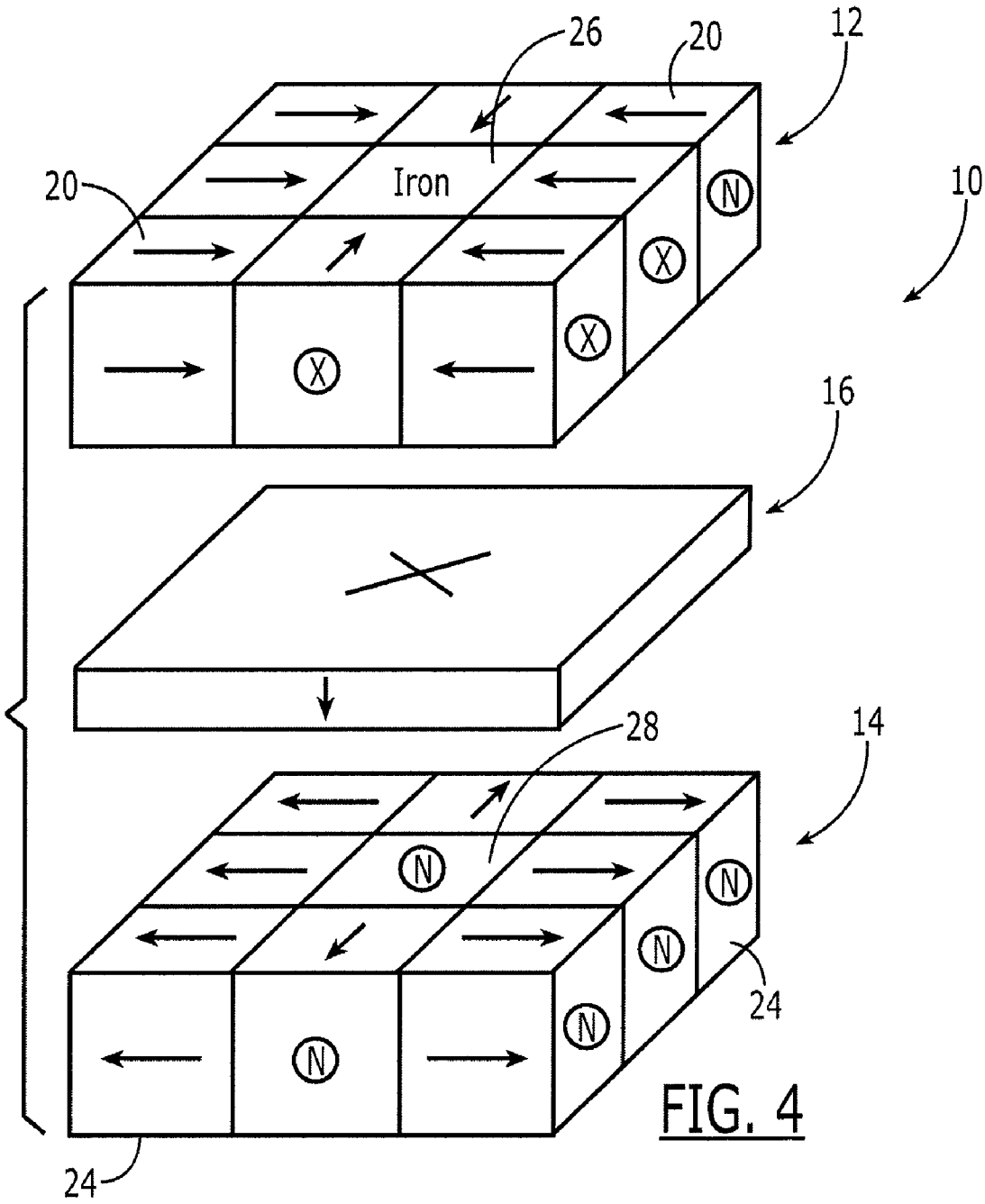
FIG. 4 is a perspective view of a magnet structure according to another embodiment of the present invention in which the first and second layers of magnets and the planar magnet are spaced apart from one another prior to assembly and with the first layer of magnets including a pole magnet formed of the material having a greater permeability than the additional magnets surrounding the pole magnet.
Figure 5:
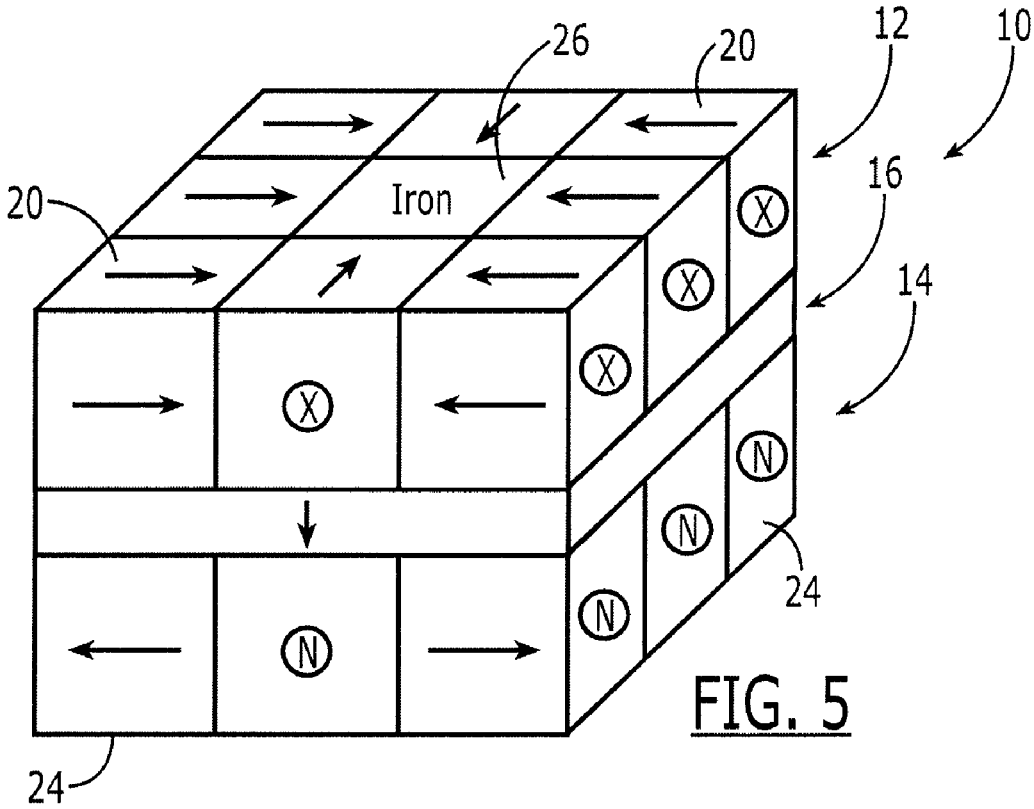
FIG. 5 is a perspective view of the magnet structure of FIG. 4 following assembly.

In the embodiment described above, the pole magnets 18, 22 are the same type of permanent magnets as the additional magnets 20, 24 surrounding the pole magnets, both in terms of size and shape and in terms of the material forming the pole magnets. However, the pole magnets may be formed of other types of materials, if so desired. As shown in the embodiment of FIGS. 4 and 5, the first layer 12 includes a pole magnet 26 that is formed of a material having a greater permeability than the additional magnets 20 that surround the pole magnet. While the pole magnet of the first layer of this alternative embodiment may be formed of various types of high permeability materials, the pole magnet of one embodiment may be formed of a high permeability material, such as soft iron, a ferrite or a mu-metal, so as to increase the flux density at the pole and to correspondingly increase the flux of the overall magnet structure 10. As shown in FIG. 4, the pole magnet of the second layer need not be formed of a high permeability material, but, instead, may be formed in the manner described above in conjunction with the embodiment of FIGS. 1 and 2. For example, the pole magnet of the second layer may be formed of the same material as the additional magnets surrounding the pole magnet, such as a neodymium iron boron material.

As described above, the magnet structure 10 of one embodiment may be in the shape of a cube formed of first and second layers of magnets 12, 14 with a planar magnet 16 disposed therebetween. A magnet assembly comprised of at least one and, more typically, a plurality of such magnet structures may also be constructed according to one embodiment of the present invention. As shown in the side view of FIG. 6, for example, a magnet assembly 34 may have first and second layers of magnets with an intermediate planar magnet. In this embodiment, the first and second layers of magnets may be formed of a pole magnet and eight additional magnets surrounding the pole magnet. In contrast to the embodiment described above in conjunction with FIGS. 1-5 in which each of the additional magnets was a single permanent magnet (such as magnet 30 of FIG. 6), each of the additional magnets of this embodiment are, in turn, formed of a pair of layers of magnets and an intervening planar magnet of the type described above in conjunction with embodiments of FIGS. 1-5 and as shown as magnet structure 32 of FIG. 6. The magnetic field of each of the magnet structures may be oriented in the manner described above and as shown in FIG. 6 so as to produce a larger and stronger magnet assembly. This process may be repeated any number of times in order to form increasingly larger magnet assemblies with increasingly stronger flux fields. One additional iteration of a magnet assembly 36 is illustrated in FIG. 6 for purposes of example, but not of limitation.

Figure 6:
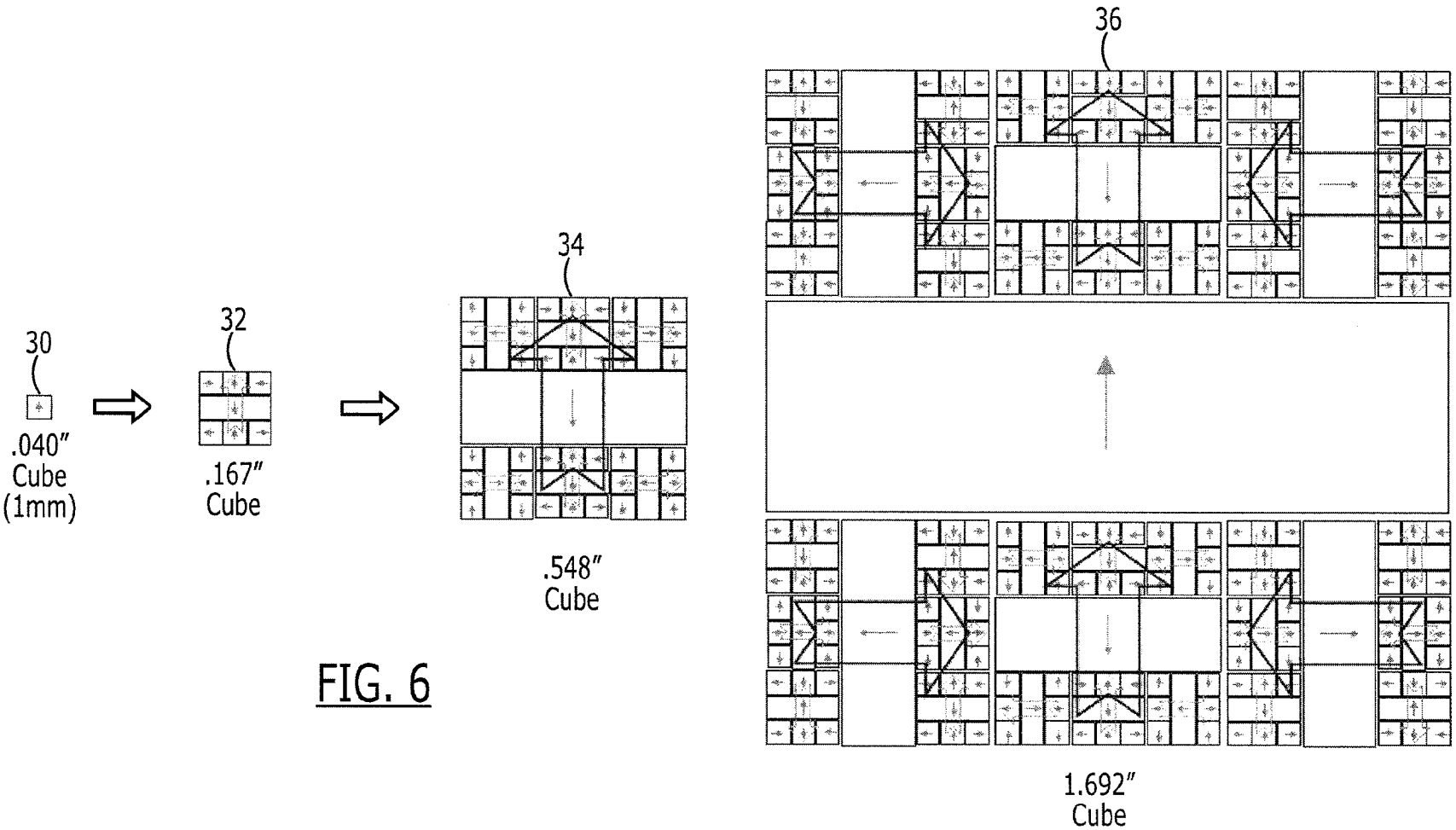
FIG. 6 is a sequential side view illustrating the construction of a magnet assembly in accordance with one embodiment of the present invention.
Figure 7:
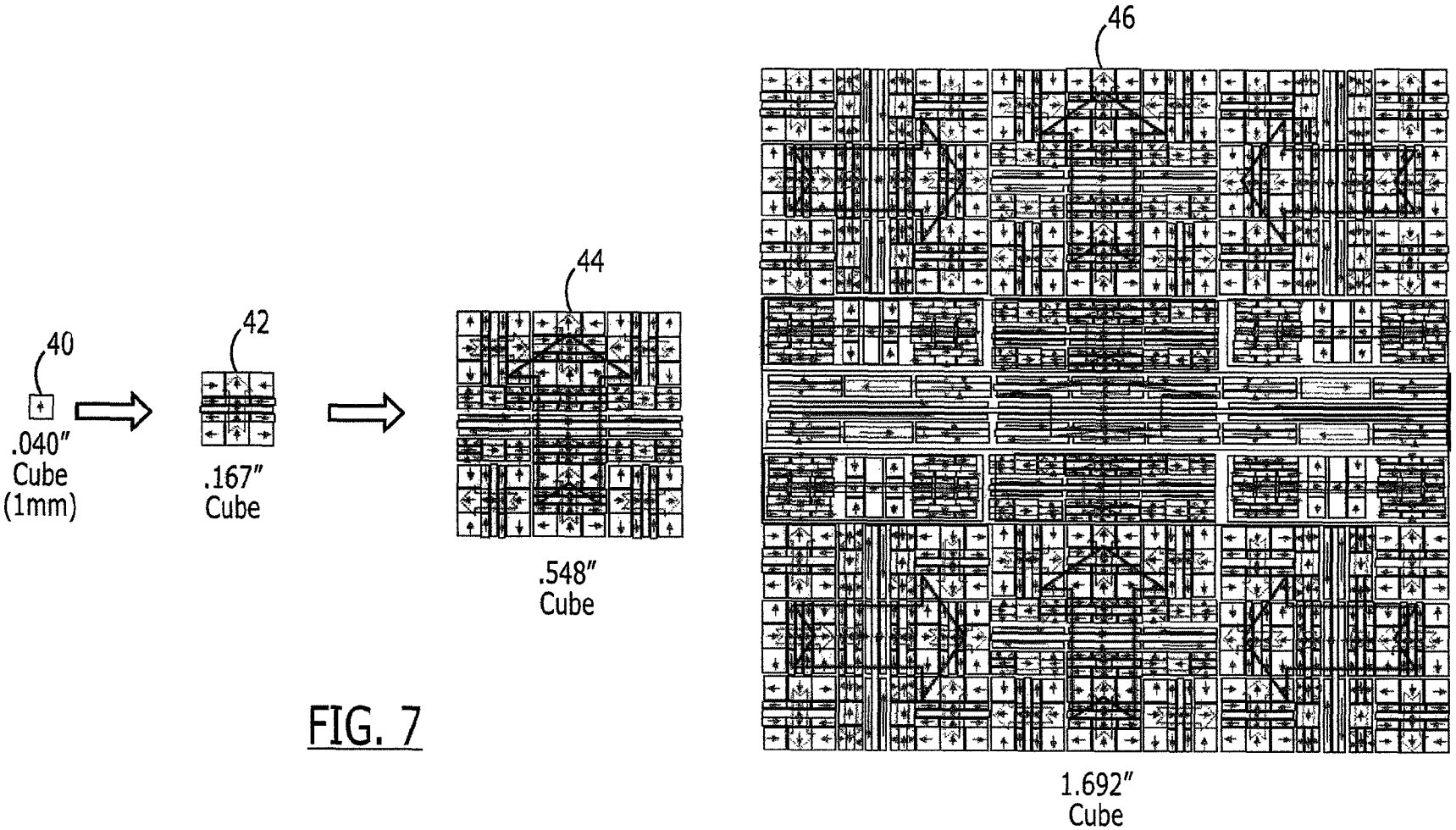
FIG. 7 is a sequential side view illustrating the construction of a magnet assembly in accordance with another embodiment of the present invention.

In the embodiment of the magnet assembly depicted in FIG. 6, planar magnets of the same type described above in conjunction with the embodiments of FIGS. 1-5 are utilized. In order to further increase the resulting flux field of the magnet assembly, magnet structures of the type depicted in FIGS. 1-5 and as shown as magnet structure 42 in FIG. 7 may also be utilized instead of the planar magnets, as shown by the magnet assembly 44 of FIG. 7. As with the embodiment of FIG. 6, this process may be repeated any number of times in order to form increasingly larger magnet assemblies with increasingly stronger flux fields. One additional iteration of a magnet assembly 46 is illustrated in FIG. 7 for purposes of example, but not of limitation.

The magnet structure 10 of embodiments of the present invention may therefore provide an increased flux field without increasing the size and weight and, in some instances, while reducing the size and weight of the magnet structure relative to comparable permanent magnets that are designed to provide the same level of flux. Thus, the magnet structure of embodiments of the present invention may be utilized in a wide variety of applications that desire or demand increased flux fields without permitting any increase in size or weight of the magnet structure. For example, electric motors and generators may utilize the magnet structure of embodiments of the present invention, such as in electric vehicles and aircraft and in renewable energy applications in which the overall efficiency is advantageously increased by providing increased magnetic flux without increasing the size and weight of the magnet structure. While the magnet structure of embodiments of the present invention may be advantageous in these applications, such as vehicular applications and renewable energy applications, the magnet structure of embodiments of the present invention may be utilized in a wide variety of other applications, if so desired.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A magnet structure comprising:

a first layer of magnets comprising a first pole magnet and a plurality of first magnets positioned about the first pole magnet and oriented such that the plurality of first magnets have respective magnetic fields directed inward relative to the first pole magnet;

a second layer of magnets comprising a second pole magnet and a plurality of second magnets positioned about the second pole magnet and oriented such that the plurality of second magnets have respective magnetic fields directed outward relative to the second pole magnet; and a planar magnet positioned between the first and second layers of magnets and oriented such that a south pole of the planar magnet is disposed in a facing relationship to a south pole of the first layer of magnets and such that a north pole of the planar magnet is disposed in a facing relationship to a north pole of the second layer of magnets, wherein the planar magnet has a magnetic field that extends in a uniform direction throughout the planar magnet.

2. A magnet structure according to claim 1 wherein the first pole magnet has a north pole that faces away from the planar magnet and the second pole magnet has a south pole that faces away from the planar magnet.

3. A magnet structure according to claim 1 wherein the first and second pole magnets are comprised of a material having greater permeability than the plurality of first and second magnets, respectively.

4. A magnet structure according to claim 3 wherein the first and second pole magnets are comprised of a material selected from the group consisting of soft iron, ferrite and mu-metals.

5. A magnet structure according to claim 1 wherein the planar magnet has a surface area at least as large as a surface area of the first and second layers of magnets.

6. A magnet structure according to claim 1 wherein the planar magnet has a thickness that is less than a thickness of the first and second layers of magnets.

7. A magnet assembly comprising:

at least one magnet structure with each magnet structure comprising:

first and second layers of magnets, each layer of magnets comprising a pole magnet and a plurality of additional magnets positioned about the pole magnet with the plurality of additional magnets of a respective layer of magnets oriented such that the plurality of additional magnets have respective magnetic fields directed in a common direction inward or outward relative to the pole magnet, wherein the pole magnets are comprised of a material having greater permeability than the plurality of additional magnets; and a planar magnet positioned between the first and second layers of magnets and oriented such that the planar magnet repels each of the first and second layers of magnets.

8. A magnet assembly according to claim 7 wherein each magnet structure has a predefined magnetic field, and wherein the at least one magnet assembly comprises a plurality of magnet structures positioned proximate one another with the predefined magnetic field of each magnet structure oriented in a common direction inward or outward.

9. A magnet assembly according to claim 7 wherein the planar magnet of each magnet structure is positioned between the first and second layers of magnets and oriented such that a south pole of the planar magnet is disposed in a facing relationship to a south pole of the first layer of magnets and such that a north pole of the planar magnet is disposed in a facing relationship to a north pole of the second layer of magnets and further such that the pole magnet of the first layer of magnets has a north pole that faces away from the planar magnet and the pole magnet of the second layer of magnets has a south pole that faces away from the planar magnet.

10. A magnet assembly according to claim 7 wherein the pole magnets are comprised of a material selected from the group consisting of soft iron, ferrite and mu-metals.

11. A magnet assembly according to claim 7 wherein the planar magnet of each magnet has a surface area at least as large as a surface area of the respective first and second layers of magnets.

12. A magnet assembly according to claim 7 wherein the planar magnet of each magnet has a thickness that is less than a thickness of the respective first and second layers of magnets.

13. A method comprising:

providing a magnet structure comprising first and second layers of magnets and a planar magnet positioned between the first and second layers of magnets and oriented such that the planar magnet repels each of the first and second layers of magnets, each layer of magnets comprising a pole magnet and a plurality of additional magnets positioned about the pole magnet with the plurality of additional magnets of a respective layer of magnets oriented such that the plurality of additional magnets have respective magnetic fields directed in a common direction inward or outward relative to the pole magnet, wherein providing the magnet structure comprises providing first and second lags of magnets with the pole magnets being comprised of a material having greater permeability than the plurality of additional magnets; and generating magnet flux utilizing the magnet structure.

14. A method according to claim 13 wherein providing the magnet structure comprises providing the first layer of magnets having a first pole magnet with a north pole oriented to face away form the planar magnet and providing the second layer of magnets having a second pole magnet with a south pole oriented to face away from the planar magnet.

15. A method according to claim 13 wherein providing the first and second layers of magnets further comprises providing first and second layers of magnets with the pole magnets being comprised of a material selected from the group consisting of soft iron, ferrite and mu-metals.

16. A method according to claim 13 wherein providing the magnet structure comprises providing the planar magnet that has a surface area at least as large as a surface area of the respective first and second layers of magnets.

17. A method according to claim 13 wherein providing the magnet structure comprises providing the planar magnet that has a thickness that is less than a thickness of the respective first and second layers of magnets.

18. A method according to claim 13 further comprising providing a magnet assembly comprised of a plurality of magnet structures with each magnet structure having a predefined magnetic field, and wherein the magnet assembly comprises the plurality of magnet structures positioned proximate one another with the predefined magnetic field of each magnet structure oriented in a common direction inward or outward.

* * * * *